US006789602B2

(12) United States Patent
Li et al.

(10) Patent No.: US 6,789,602 B2
(45) Date of Patent: Sep. 14, 2004

(54) PROCESS FOR PRODUCING ALUMINUM SHEET PRODUCT HAVING CONTROLLED RECRYSTALLIZATION

(75) Inventors: Zhong Li, Dover, OH (US); Paul Platek, Massillon, OH (US)

(73) Assignee: Commonwealth Industries, Inc., Urichsville, OH (US)

( * ) Notice: Subject to any disclaimer, the term of this patent is extended or adjusted under 35 U.S.C. 154(b) by 7 days.

(21) Appl. No.: 10/072,409

(22) Filed: Feb. 11, 2002

(65) Prior Publication Data

US 2003/0150587 A1 Aug. 14, 2003

(51) Int. Cl.[7] ..... B22D 46/00

(52) U.S. Cl. ..... 164/4.1; 164/455; 164/454; 164/485

(58) Field of Search ..... 164/4.1, 455, 454, 164/477, 481, 485, 476, 452

(56) References Cited

U.S. PATENT DOCUMENTS

| | | | | |
|---|---|---|---|---|
| 2,709,843 A | | 6/1955 | Hartley | 22/89 |
| 2,848,008 A | | 8/1958 | Dietert et al. | 137/90 |
| 4,066,114 A | | 1/1978 | Dorr et al. | 164/4 |
| 4,306,610 A | | 12/1981 | Ahmed | 164/4.1 |
| 4,721,154 A | | 1/1988 | Christ et al. | 164/452 |
| 5,069,267 A | | 12/1991 | Larsen | 164/155 |
| 5,454,417 A | | 10/1995 | Rosenstock | 164/455 |
| 5,634,991 A | * | 6/1997 | Kamat | 148/551 |
| 5,666,842 A | * | 9/1997 | Komatsubara et al. | 72/200 |
| 5,673,746 A | | 10/1997 | Chun et al. | 164/454 |
| 5,697,423 A | | 12/1997 | Roder et al. | 164/414 |
| 6,044,895 A | | 4/2000 | Kuttner et al. | 164/155.4 |
| 6,045,632 A | * | 4/2000 | Sun et al. | 148/551 |
| 6,086,690 A | * | 7/2000 | Wycliffe et al. | 148/552 |
| 6,264,765 B1 | | 7/2001 | Bryant et al. | 148/511 |
| 6,280,543 B1 | * | 8/2001 | Zonker et al. | 148/551 |
| 6,290,784 B1 | * | 9/2001 | Yasuhara et al. | 148/320 |

* cited by examiner

*Primary Examiner*—Kiley Stoner
*Assistant Examiner*—Len Tran
(74) *Attorney, Agent, or Firm*—Andrew Alexander

(57) ABSTRACT

A process for producing aluminum sheet product having a controlled grain structure and texture using a continuous caster to cast molten aluminum into a slab comprising the steps of providing a source of molten aluminum and continuously casting the molten aluminum into a slab using a continuous caster; continuously rolling the slab into a sheet product and continuously annealing the sheet product in a controlled temperature range; measuring grain structure and texture of the sheet product to provide a grain structure and texture related signal on a continuous basis; and relaying the signal to a controller. In the controller, comparing the signal to previous signals reflecting grain structure and texture of the sheet product to provide a comparison; and in response to the comparison, maintaining or changing heat input to the process upwardly or downwardly to increase or decrease the temperature to produce aluminum sheet having the desired grain structure and texture.

63 Claims, 1 Drawing Sheet

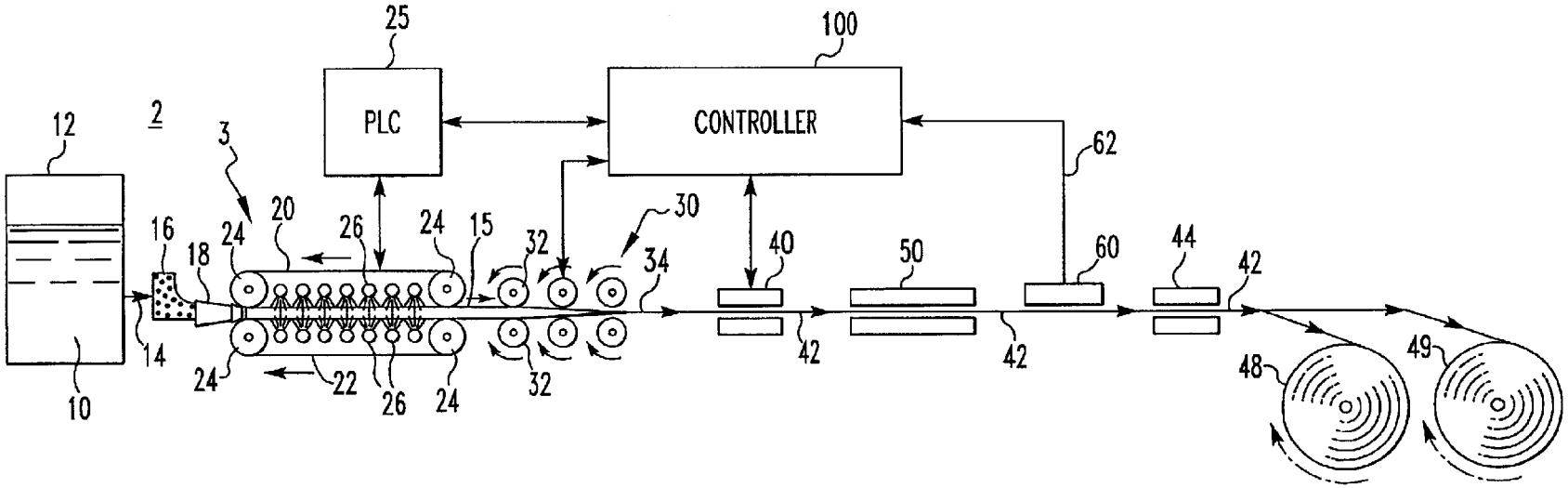
CONTROLLER
PLC
100
25
62
60
44
42
49
48
50
40
30
34
32
15
24
26
22
20
3
18
16
14
2
12
10

PROCESS FOR PRODUCING ALUMINUM SHEET PRODUCT HAVING CONTROLLED RECRYSTALLIZATION

BACKGROUND OF THE INVENTION

This invention relates to aluminum alloys and more particularly, it relates to a control process for producing aluminum alloy sheet product having controlled recrystallization.

In many instances, continuous casting of molten aluminum into slab utilizing twin belt or twin roll casters is favored over DC casting because the twin belt or twin roll casting can result in substantial energy savings and total conversion cost savings compared to the DC cast method. In the twin belt or twin roll process, molten metal is continuously introduced to an advancing mold and a slab is produced which may be continuously formed into a sheet product which is collected or wound into a coil. However, the continuous process is not without problems. The texture and grain structure formed during processing of the molten aluminum into a sheet product determines mechanical anisotropy which strongly influences formability of the final product. Conventionally, texture and grain structure are determined after a coil of the sheet product is produced. However, if the texture and grain structure are unsuitable for final formability purposes, e.g., low formability and unsuitable earing, then the coil has to be scrapped or reprocessed, greatly adding to the cost of sheet product having acceptable formability. Thus, there is a great need for a process for continuous casting and rolling aluminum into a sheet product which avoids these problems.

The continuous casting of molten aluminum and rolling slab produced therefrom into a sheet product is disclosed in various patents. For example, U.S. Pat. No. 5,976,279 discloses a process for continuously casting aluminum alloys and improved aluminum alloy compositions. The process includes the steps of continuously annealing the cold rolled strip in an intermediate anneal using an induction heater and/or continuously annealing the hot rolled strip in an induction heater. The alloy composition has mechanical properties that can be varied selectively by varying the time and temperature of a stabilizing anneal.

U.S. Pat. No. 6,264,765 discloses a method and apparatus for casting, hot rolling and annealing non-heat treatment aluminum alloys. The method and apparatus comprises continuous casting, hot rolling and in-line inductively heating the aluminum sheet to obtain the mechanical properties within the specification tolerance of the hot rolled product.

U.S. Pat. No. 5,985,058 discloses a process for continuously casting aluminum alloys and improved aluminum alloy compositions. The process includes the step of heating the cast strip before, during or after hot rolling to a temperature in excess of the output temperature of the cast strip from the chill blocks. The alloy composition has a relatively low magnesium content yet possesses superior strength properties.

U.S. Pat. No. 5,993,573 discloses a process for continuously casting aluminum alloys and improved aluminum alloy compositions. The process includes the steps of (a) heating the cast strip before, during or after hot rolling to a temperature in excess of the output temperature of the cast strip from the chill blocks and (b) stabilization or back annealing in an induction heater of cold rolled strip produced from the cast strip.

U.S. Pat. No. 5,833,775 discloses an aluminum alloy sheet and a method for producing an aluminum alloy sheet.

The aluminum alloy sheet is useful for forming into drawn and ironed container bodies. The sheet preferably has an after-bake yield strength of at least about 37 ksi and an elongation of at least about 2 percent. Preferably the sheet also has earing of less than about 2 percent.

U.S. Pat. No. 6,044,895 discloses a continuous casting and rolling system for steel strips which includes a vertically working two-roll casting device, a first device for adding molten steel to the casting device, a second device for guiding a cast strip produced by the casting device into a horizontal position, a horizontally working rolling mill for working the cast strip, and a reel device receiving the strip worked in the horizontally working rolling mill. Each of the casting device, the first device, the second device, the horizontally working rolling mill and the reel device are controlled by respective individual closed-loop control systems.

U.S. Pat. No. 5,839,500 discloses a method which enhances the quality of cast metal being cast in a continuous casting process. In particular, the method combines temperature and quality control sensing to achieve closed-loop control of the cooling of molten metal in a continuous caster.

U.S. Pat. No. 4,066,114 discloses the continuous casting of steel supervised and controlled by measuring total heat flow and the ratio of upper to lower heat flow into the mold and causing these two valves directly or indirectly to be represented in a two dimensional field. The resulting operating point must remain within an empirically predetermined range for safe operation without skin rupture.

U.S. Pat. No. 4,306,610 discloses a method for controlling the casting rate in the continuous casting of liquid metals by monitoring the casting temperature downstream from the continuous casting mold and opening or closing the bottom-pour nozzles on the hot metal vessels when the casting temperature at such point deviates from a preselected temperature range. The method includes switching of the control strand in multiple strand casters whenever the control strand has some difficulty.

U.S. Pat. No. 4,721,154 discloses that during the melt spinning process for producing metal foils having an amorphous structure, molten metal is cast through a slot-like nozzle onto a surface or wall which is rapidly moved past the nozzle. A particularly rapid quenching and cooling rate of the solidifying melt is achieved by providing cooling support elements which are supplied with a cooling pressure medium on one side of the moved surface or wall and which aide is located opposite to or remote from the nozzle. The surface or wall is constructed as a thin-walled cylindrical shell or tube which is elastically deformable to some extent. In its shell interior, there are provided a number of rows of cooling support elements which may be controlled by thickness sensors and temperature profile sensors. There is thus rendered possible, the continuous production of amorphous metal foils.

U.S. Pat. No. 5,069,267 discloses an automatic foundry plant of the kind in which two or several sideways switchable switching conveyors are placed between the pouring station and the extraction station in order to obtain the requisite cooling of the poured molds before these arrive to the extraction station and at the same time to limit the length of the plant, the new feature consists in automatic equipment, which controls the crosswise movements of the switching conveyors to take place at times when the risk is as small as possible of damaging molds situated in the transition region between the mold conveyor and the switching conveyor in question.

U.S. Pat. No. 5,454,417 discloses a method for casting steels on arcuate continuous casting installations, a steel melt being passed through a water-cooled chill mold from which a steel product emerges which has solidified at the surface and is cooled by the action of coolants for the further solidification, deflected circularly over supporting rollers, and subsequently bent from the arc by means of multi-point bending equipment back into the horizontal. The force for straightening the arc-shaped steel product is calculated from the high-temperature properties of the steel determined from high-temperature tensile tests and from the temperature profiles of the steel product calculated from surface temperatures. By a theoretical-actual comparison of values of the calculated straightening force and the actually determined straightening force, the casting conditions and the cooling are controlled so that the steel product is treated as gently as possible during the straightening, whereby surface fissures can be largely excluded.

U.S. Pat. No. 5,673,746 discloses a liquid metal/solid metal interface detecting device which comprises in general a radiation source for generating gamma radiation, which is directed to pass through a strand extruded from a continuous casting mold. A detector detects the gamma radiation passing through the partially solidified strand to determine a spatial profile for a liquid metal/solid metal interface by relying on the different gamma radiation attenuation characteristics of the solid metal and the liquid metal. Preferably, the gamma radiation is at energies of greater than one million electron volts. In some embodiments, a movable support carries the radiation source and the detector and moves the radiation source and detector along and around the ingot enabling generation of a three-dimensional profile of the liquid metal/solid metal interface by utilizing tomographic imaging techniques. Alternatively, solidification at a single region is determined and this information is used to control the formation of the strand in process controller implementations. Surface temperature detectors can also be used to provide more information about the solidification.

U.S. Pat. No. 5,697,423 discloses a continuous block caster having a temperature sensor in each of the chilling blocks. The sensor monitor and control temperatures of the chilling blocks in the casting direction (the "x-direction") and the direction transverse to the casting direction (the "y-direction").

In spite of these disclosures, there is a great need for a control method for continuously casting slab to be rolled into aluminum sheet, the method adapted to be adjusted on a continuous basis to provide aluminum sheet having high levels of formability and low or optimum levels of earing, for example, which avoids the need for reprocessing or scrapping coils of sheet product.

The term "formability" when used herein is used to describe the ease with which a sheet of metal can be shaped through plastic deformation. Formability of a metal can be evaluated by measuring strength, ductility, and the amount of deformation to cause failure.

Earing occurs with the peaks of the projections resulting from directional differences in the plastic working properties of rolled metal located at 45 degrees and/or 0 or 90 degrees to the rolling direction. Degree of earing is the difference between average height at the peaks and average height at the valleys, divided by the average cup height, multiplied by 100 and expressed in percent. High earing is a problem, for instance in beverage container making operations. It can cause jamming of can-making machinery and result in a substantial amount of scrap upon trimming the container. Thus, preferably earing should be less than 2% for can body sheet.

The term "aluminum" when used herein is meant to include aluminum and its alloys.

SUMMARY OF THE INVENTION

It is an object of the invention to provide an improved process including continuous casting and rolling to continuously produce aluminum sheet product having consistent levels of formability.

It is another object of the invention to provide a process including continuously casting a slab and rolling said slab into a sheet product wherein the process is controlled using texture and grain structure to produce consistent or optimum levels of formability and earing.

It is still another object of the invention to provide a system employing continuous casting of molten aluminum into slab and rolling the slab into sheet product having consistently high levels of formability and low or optimum levels of earing by monitoring sheet texture and grain structure to control heat input to the system.

And yet it is another object of the invention to provide an improved process for producing aluminum sheet product employing a continuous caster to produce slab, continuously rolling said slab to produce a sheet product and continuously annealing the sheet product, the texture and grain structure of the sheet product monitored to maintain or adjust the temperature of annealing.

Still it is another object of the invention to provide a continuous caster, rolling and annealing system to produce high formability aluminum sheet using a controller to compare the degree and/or type of recrystallization of the aluminum sheet on a continuous basis to previous recrystallization measurements and control heat to the system such as the annealing temperature to maintain the desired degree and type of recrystallization.

It is another object of the invention to provide aluminum alloys such as AA3XXX and AA5XXX series alloys in sheet stock having high levels of formability and optimum levels of earing by monitoring texture and grain structure on a continuous basis for adjusting the process to improve formability and earing.

These and other objects will become apparent from a reading of the specification and claims appended hereto.

In accordance with these objects, there is provided a process for producing aluminum sheet product having a controlled recrystallization using a continuous caster to cast molten aluminum into a slab comprising the steps of providing a source of molten aluminum and continuously casting the molten aluminum into a slab; continuously rolling the slab into a sheet product and continuously annealing the sheet product in a controlled temperature range; measuring the degree and type of recrystallization of the sheet product to provide a recrystallization related signal on a continuous basis; and relaying the signal to a controller. In the controller, comparing the signal to previous signals reflecting the degree and type of recrystallization of the sheet product to provide a comparison; and in response to the comparison, maintaining or changing heat input to the process, e.g., the annealing step, upwardly or downwardly to increase or decrease the temperature to produce aluminum sheet having the desired recrystallization. Alternatively, the temperature of hot rolling may be increased or decreased to provide a sheet product having the required degree and type of recrystallization.

BRIEF DESCRIPTION OF THE DRAWING

The FIGURE is a schematic representation of the process of the invention showing a continuous caster, hot rolling mill, induction heater, quench, recrystallization measuring unit and controller for the system.

DETAILED DESCRIPTION OF PREFERRED EMBODIMENTS

Referring now to the FIGURE, there is shown a schematic representation of a system 2 employing a belt caster 3 for producing aluminum sheet in accordance with the invention. In the FIGURE, molten metal 10 is provided in a furnace or reservoir 12. Molten metal from reservoir 12 is directed along line 14 to tundish 16 from where it is metered through a nozzle 18 into an advancing mold created by revolving belts 20 and 22 and side dams (not shown). Belts 20 and 22 are turned by means of rolls 24. Molten metal, e.g., molten aluminum, is solidified to form a continuous slab 15 between belts 20 and 22 which are chilled using coolant spray 26. Belt caster 3 is described in U.S. Pat. Nos. 3,864,973; 3,921,697; 4,648,438; 4,940,076 and 4,972,900, incorporated herein by reference as if specifically set forth. Improved nozzles for a belt caster are set forth in U.S. Pat. No. 5,452,827, incorporated herein by reference.

Another casting apparatus that may be used in the present invention is a block caster wherein the blocks are connected to form belts and is included herein as a belt caster. As described with respect to belt caster 3, a tundish and nozzle are provided to transfer molten metal to the block belts of the block caster wherein solidification occurs to provide a solidified slab 15 and the blocks are chilled to aid in solidification of the molten metal.

Yet another apparatus that may be utilized to cast a continuous strip or slab 15 is a roll caster which includes two rolls which rotate to provide the continuously advancing mold. As in the belt caster, a tundish and nozzle are used to transfer molten aluminum to the mold defined by the two rolls. Again, the rolls are normally chilled to aid in solidification of the molten metal into a strip or slab. The different casters are described in U.S. Pat. No. 5,452,827.

Molten aluminum is typically introduced to the caster in a temperature range of about 1220° to 1320° F. and typically exits the caster at a temperature in the range of 750° to 1150° F., depending on the aluminum alloy being cast. In addition, typically the continuous slab exiting the belt caster has a thickness in the range of 0.1 to 2 inches, for example, 0.2 to 1 inch.

It will be appreciated that the present invention has the capability to consistently and continuously produce aluminum alloy sheet product having highly desirable texture and grain structure, e.g., completely recrystallized, for improved forming with low or optimum earing. By use of the present invention, the process has the capability of changing the processing conditions on-line in real time to maintain the highly desired texture and grain structure desired for forming, for example, thereby minimizing scrap generation or re-processing rolls of sheet product having unacceptable formability and earing.

In the present invention, it is the substantially completely recrystallized structures which provide for high formability and low or optimum earing. Further, hot rolling and/or annealing, for example, are required to be controlled in the present invention to prevent development of unsuitable grain structure and texture, for example, and its attendant low formability and undesirable earing. Thus, in the invention the process is controlled to change operating conditions on-line in real time, such as hot rolling temperature and annealing temperature, for example, to obtain sheet product having the fully recrystallized fine grain structure sometimes referred to as primary recrystallization. Care is required to avoid over annealing and the growth of fine grains to provide large grains or abnormal grain growth referred to as secondary recrystallization which lead to low formability and high earing.

That is, the present invention permits on-line determination of texture and grain structure during production and immediate or on-line controlling or changing of texture and grain structure to continuously provide aluminum alloy sheet product having highly desired forming and earing characteristics, for example. In the present invention, the sheet product is examined on a continuous basis to determine if the highly desired texture and grain structure are being produced. The processing parameters are maintained or changed on an automatic basis to ensure the desired texture and grain structure, greatly minimizing generation of rolls or coils of scrap or unacceptable aluminum alloy sheet product.

This process is to be contrasted with conventional technology wherein casting, hot rolling, and annealing take place to produce a roll or coil of sheet product and samples are then cut from the roll to determine if the sheet product contained in the roll has acceptable texture and grain structure for forming. If the roll of sheet product does not have acceptable texture or grain structure, then it has to be reprocessed or scrapped. The term "texture" as used herein refers to crystallographic planes and directions which tend to align themselves in a preferred manner with respect to the direction of maximum strain during thermomechanical processing of a metal. By the term "grain structure" as used herein is meant the shape and size of the grain and can include size distribution of the grain.

Referring again to the FIGURE and referring to the present invention, it should be noted that during casting controller 100 sends temperature setpoint input signals to caster controller PLC 25 (Programmable Logical Controller) based on the grain structure and texture measurements. Caster PLC 25 adjusts casting operating parameters to achieve the desired slab temperature, for example, exiting the caster.

After exiting the caster, the slab 15 is directed to rolling mill 30 where it is rolled to form a rolled strip or flat product 34 using preferably a hot mill. Hot mill 30 is comprised of one or more pairs of oppositely opposed rolls 32 which reduces the thickness of the slab a controlled amount as it passes between each stand of rolls. Three sets of hot stands or rolls are illustrated in the FIGURE. For example, slab 15 having a thickness of about 0.2 to 1 inch would be reduced to a sheet product having a thickness of about 0.01 to 0.25 inch. The thinner gauge can be used for drawn and iron cans and thicker gauge, e.g., 0.25 inch, used for wheel rim stock. The temperature of the slab entering hot mill 30 would typically be in the range of about 700° to 1100° F., if no heat is added. Typically, temperature of sheet product exiting mill 30 would be in the range of 350° to 700° F. In another aspect of the invention, the slab from caster 3 may be heated (not shown in the FIGURE) to a temperature of 800° to 1100° F. to aid in improving the texture and grain structure of the slab prior to hot rolling. Thus, slab entering the hot mill will have temperatures of about 800° to 1100° F.

Hot mill 30 can reduce the thickness of the slab about 60 to 95% of its thickness, with typical reduction being 80 to 95% reductions. Depending on the alloy and the end use of the sheet product, heat may be applied to the strip or slab between hot stands in addition to or instead of heating prior to the hot mill.

The temperature of the aluminium alloy sheet exiting the hot mill is typically in the range of about 500° to 825° F., depending on the alloy and the heat input applied before or during hot rolling.

After hot rolling, hot rolled strip 34 can have a hot rolled texture and grain structure which is a highly worked structure containing subgrains and as worked crystallographic texture. The hot rolled strip can have a partial or fully recrystallized grain structure with an optimum texture depending on previous heat input and rolling reduction. If the structure remains deformed and a recrystallized grain structure is necessary for the end product, then in-line annealing of the hot rolled strip 34 can be applied to promote recrystallization of the worked structures. For example, it is important for automotive application using 5XXX aluminum alloys to have a fine, fully recrystallized grain structure with low intensity of either recrystallization or deformation texture for the purpose of forming and low earing. Thus, in the present invention, the hot rolled sheet can be fully annealed in annealer 40 to promote primary recrystallization having fine grain structure by controlling heat input and rolling reduction.

Controller 100 can be set up to monitor hot mill 30 operations by monitoring temperature of aluminum slab entering hot mill 30. Also, controller 100 can monitor hot milling reduction in the slab, the amount of hot mill coolant applied, and hot rolling speed. Thus, controller 100 can operate to increase or decrease the temperature of the sheet exiting the hot mill, and change the amount of reductions, the amount of hot mill coolant, and the speed of the rolls as desired. It will be appreciated that hot roll reductions to final gauge can eliminate further reductions by cold rolling, for example, thereby providing significant savings. Further, if sufficient heat is applied, there may be no need for further annealing to provide texture and grain structure desired. That is, the hot rolled sheet may be cooled in air to room temperature or it may be quenched rapidly for further cold rolling, for example, depending on the alloy and the end use of the sheet product.

Referring to the FIGURE, it will be seen in the embodiment illustrated that the hot rolled sheet product is directed to a continuous annealer 40, using a heater such as an infrared, solenoidal or transverse flux induction heater. While any continuous heater may be used, an induction heater is preferred. While hot rolling of continuous cast slab may provide the required crystallographic texture, such as preferred grain orientation and grain structure, such as shape and size, continuous annealing can be used to ensure the desired mechanical properties of the final sheet product. Continuous anneal may also be required if cold rolling (not shown in the FIGURE) of the hot rolled strip is necessary. Thus, the hot rolled strip may be continuously annealed in annealer 40 in a temperature range of 600° to 1100° F. in time periods from 0.5 to 60 seconds in order to effect fully recrystallized sheet having fine grains and highly desired formability properties. However, care is required that the sheet product is not over annealed to the point where secondary recrystallization occurs. Secondary recrystallization is the growth of fine grains into undesirable coarse grains which are detrimental to formability and produce undesirable earing and its attendant problems.

Controller 100 can monitor the annealing operation by monitoring the temperature of the hot rolled strip entering annealer 40. Also, controller 100 can monitor the exit temperature of strip or sheet 42 leaving the annealing operation to ensure that the hot rolled strip is not under or over annealed. That is, annealer 40 is controlled by controller 100. Thus, controller 100 can operate to increase or decrease the heat input in annealer 40 to increase or decrease the temperature of the annealing operations to ensure that the sheet product has the required texture and grain structure necessary to fabricating the finished products.

After hot rolling, the hot rolled sheet or flat product may be allowed to cool prior to other operations, depending on the alloy being cast and its intended use. For example, after hot rolling, with or without annealing and cooling, the resulting strip 42 may be cold rolled (not shown in the FIGURE) to a sheet product having a final gauge. The cold rolling may be achieved by passing strip 42 through several pairs or stands comprising a cold mill to provide the cold rolling required to produce the final gauge. Cold rolling can reduce the thickness of strip 42 by 20% to 90%. Final gauge can range from 0.01 to 0.014 inch for drawn and ironed food and beverage containers and 0.04 to 0.16 inch for automotive applications. It will be appreciated that the cold rolling can be performed in a cold rolling line separate from the subject continuous casting and rolling line.

After cold rolling to final gauge, the sheet product may be subject to further anneal to ensure the required crystallographic texture and grain structure necessary for forming into the final product.

After hot rolling or annealing sheet 42 may be subject to a continuous rapid quenching such as cold water quench 50 prior to further operations. Quench 50, if used and shown after anneal, can be located at different locations in the process.

In accordance with the invention, the texture and/or grain structure of hot rolled or annealed sheet product is measured on a continuous basis using texture and grain structure analyzer 60 and a texture and grain structure related signal is directed along line 62 to controller 100. In response thereto, operating conditions such as hot rolling temperature, hot rolling reduction and/or speed, mill coolant, or anneal temperature, can be adjusted, if necessary, to provide a sheet product having the desired texture and grain structure. Thereafter, sheet product 42 may be cut by shear 44 and coiled into coils 48 and 49. Thus, it will be seen that using the on-line texture and grain structure analyzer optimum conditions can be maintained to produce a sheet product having texture and grain structure which provides, for example, high formability and low or optimum earing resulting in minimal scrap generation or reprocessing of coils having unsuitable forming characteristics.

That is, the on-line texture and grain structure analyzer 60 measures the quality of sheet product, for example, from the hot rolling or annealing operations, depending on the process, and generates a texture and grain structure signal or measurement. This signal or measurement is relayed to controller 100 along line 62. Controller 100 is set up to compare the present texture and grain structure measurements with prior texture and grain structure measurements or a standard or range of texture and grain structure measurements. Controller 100 then determines, for example, if the temperature of sheet in annealer 40 should be maintained or adjusted upwardly or downwardly within a controlled temperature range to maintain or improve the texture and grain structure and thus maintain or improve formability of the sheet product being produced. Likewise, hot rolling temperature may be maintained or adjusted upwardly or downwardly individually within a controlled temperature range or in conjunction with anneal temperature to maintain or improve the texture and/or grain structure suited to the desired levels of formability and/or earing.

If the determination is made by controller 100 that desired texture and grain structure of sheet product 42 exiting annealer 40 is not being obtained, and the temperature in annealer 40 should be adjusted upwardly, then a signal is sent to annealer 40 and the temperature in annealer 40 is increased to a predetermined level. Or, if the determination is made by controller 100 that secondary recrystallization (abnormal grain growth) is occurring, then controller 100 sends a signal to annealer 40 to reduce the annealing temperature a controlled amount, until the texture and grain structure analyzer obtains predetermined readings or measurements indicating sheet product is being produced having requisite texture and grain structure suitable for the desired formability and earing, for example.

The temperature of the sheet product exiting hot rolling operation 30 and/or annealer 40 which determines texture and grain structure is continuously monitored and relayed to controller 100. Continuous monitoring of sheet temperatures exiting hot rolling operation 30 and/or annealer 40 provides controller 100 with information respecting sheet 34 or 42 and permits determination by controller 100 whether the temperature is being maintained or changing, i.e., increasing or decreasing.

Controller 100 can be programmed to maintain the texture and grain structure of sheet product 42 within a given range or it can be programmed to improve the texture and grain structure within the range. That is, if the last change in annealing temperature was an increase in temperature of 10° F., for example, and this improved texture and grain structure, controller 100 can be programmed to increase the temperature another 10° F. again. It will be appreciated that similar changes can be made to hot rolling temperature or casting temperature to effect the same result. That is, hot rolling or casting temperature can be increased to increase annealing temperature or combinations may be used. This function can be continued to obtain the most desirable level of texture and grain structure suited to forming and/or earing. However, as noted, these values must be maintained within controlled ranges. That is, if annealing or hot rolling temperature are too high, this can lead to formation of secondary recrystallization (growth of small grains into large grains) having poor formability and undesirable earing properties. However, it should be understood that if the texture and grain structure meet the desired values, no adjustment of the annealing temperature is necessary. Further, if secondary recrystallization is detected by analyzer 60, then the anneal temperature can be incrementally lowered, for example at a rate of 10° F. until the requisite primary recrystallization is obtained with the attendant level of desired formability and/or earing, for example.

In operation, the controller makes the comparison, using stored values in memory, and for example a logic table or any suitable control algorithm, and decides whether the anneal temperature, for example, should stay the same, or should increase or decrease. Then, the controller sends a signal to the controller for annealer 40 to maintain, raise or lower temperature set point for annealer 40. The basis for resetting the set point can be an adjustable incremental change in the set point value. During normal operation, steps or changes of as small as 5 to 10° F. can typically be used. The same operation may be applied to hot rolling, or other operations in the casting system. Implementation of the change is handled by an anneal controller which can be any suitable stand-alone PID (proportional integral derivative) or similar controller or can also be written in programmable logic control code.

In the present invention, it is not the temperature of the sheet or strip 34 entering or exiting annealer 40 (or caster or hot mill) that is used to control the texture and grain structure of the sheet product obtained by this process. Instead, it is texture and grain structure of the sheet product and its trend with time that determines or is used as a control for producing sheet product having the desired levels of formability and/or earing. Thus, for example, there may be no need to change casting or hot rolling parameters once set. That is, adjusting anneal temperature or duration of anneal in accordance with the invention as described may be sufficient.

In another aspect of the invention the anneal temperature may be held substantially constant and a change in temperature of the sheet product effected by change in hot rolling temperature. That is, temperature of sheet 34 entering annealer 40 can be higher by virtue of an increase in temperature of slab 15 leaving caster 3 or entering hot mill 30 or as a result of heat being applied before or during the hot rolling operation. All of such combinations are intended to be included within the purview of the invention as if specifically set forth.

If the process does not use an anneal but instead uses sheet product rolled to gauge in hot mill 30, then control of the texture and grain structure of the sheet product is controlled as described with respect to anneal. That is, analyzer 60 measures the texture and grain structure to produce a texture and grain related signal which is relayed to controller 100. This is compared to stored values and controller 100 makes the determination whether the temperature of slab 15 entering hot mill 3 (or between passes in hot mill 30) should be maintained, raised or lowered. Controller 100 then sends a signal to the hot mill controller to maintain, raise or lower the temperature of slab 15 entering hot mill 30. It will be appreciated that the temperature of slab 15 entering or between passes in hot mill 30 may be raised or lowered using an on-line induction heater as noted. Based on the comparison results of texture and grain structure from controller 100, manual adjustments to the operating parameters can be made in order to have the right texture and grain structure for the product.

It will be appreciated that a combination of changes to temperature may be used including changes to annealer 40 and hot slab entering or between hot stands and such is contemplated within the invention.

The crystallographic texture and grain structure measuring unit can be also installed on finishing lines such as tension leveler or slitter to monitor the texture and grain structure. The advantage of the invention is that it can provide means to measure the uniformity of the crystallographic texture and grain structure of the whole coil. Therefore, it eliminates the need to cut samples to measure the texture and grain structure, where only limited areas of the coil are measured.

Texture and grain structure can be measured on a continuous basis on-line using electromagnetic acoustic transducers (EMAT) or using laser-ultrasound resonance spectroscopy equipment.

The use of electromagnetic acoustic transducers and laser-ultrasound resonance spectroscopy for measuring texture and grain structure is set forth in DOE Project No. DE-FC07-00ED 13902 entitled "Textures in Strip-Cast Aluminum Alloys: Their On-Line Monitoring and Quantitative Effects on Formability" and in a Year 1 Technical Progress Report on Project No. DE-FC07-00ID13902 dated May 1, 2001, both of which are incorporated herein as if specifically set forth. The Year 1 Technical Progress Report discloses that primary recrystallization, grain growth, and secondary recrystallization of strip-cast AA5XXX alloy sheet can be monitored by either laser-ultrasound resonance or electromagnetic acoustic transducers. It is further reported that texture coefficient W400 is a good indicator of the degree of recrystallization and grain growth in annealing of AA5XXX alloy. Further, it is reported that in using laser ultrasonic measurements velocity ratio κ correlates well with $W_{400}$ over a broad range of temperatures. In addition, it is reported that grain size can be monitored by measuring laser ultrasonic attenuation. The technology disclosed in DOE Project No. DE-FC07-00ID13902 or the Year 1 Technical Progress Report form no part of the subject invention but report measuring primary and secondary recrystallization and grain size in aluminum alloys. That is, the DOE Project and Year 1 Technical Progress Report disclose methods and equipment for measuring primary or secondary recrystallization and grain size of aluminum alloys. For example, the Year 1 Progress Report discloses that in aluminum sheet, AA5XXX alloy, deformed textures will have negative $W_{400}$ values and that when hot/cold rolled sheet is annealed, the $W_{400}$ will assume a positive value as primary recrystallization progresses and that grain growth and/or secondary recrystallization will lead to further increases in $W_{400}$.

Any aluminum alloy which may be continuously cast and rolled into a sheet product can be produced in accordance with the invention. Such alloys include heat treatable aluminum alloys such as the AA2XXX, 6XXX and 7XXX series aluminum alloys or the non-heat treatable aluminum alloys such as AA1XXX, 3XXX and 5XXX series aluminum alloys. The invention has particular application to aluminum alloys where high levels of formability and low earing is desired such as aluminum alloys used for food and beverage containers, for example, AA3004. Also, it is particularly suitable for aluminum alloys used for automotive applications such as AA5754.

Having described the presently preferred embodiments, it is to be understood that the invention may be otherwise embodied within the scope of the appended claims.

What is claimed is:

1. A process for producing an aluminum alloy sheet product having a controlled recrystallization using a continuous caster to cast a molten aluminum alloy into a slab comprising:

(a) providing a source of molten aluminum alloy;

(b) providing a caster for continuously casting said molten aluminum alloy into a slab;

(c) rolling said slab into a sheet product;

(d) continuously annealing said sheet product at a temperature in a controlled temperature range;

(e) measuring degree of recrystallization of said sheet product on a continuous basis to provide a recrystallization related signal;

(f) relaying said signal to a controller;

(g) in said controller, comparing said signal to previous signals relating degree of recrystallization of said sheet product to provide a comparison; and (h) in response to said comparison, maintaining or changing said temperature in said temperature range upwardly or downwardly to produce aluminum sheet product having desired recrystallization.

2. The process in accordance with claim 1 wherein said rolling is hot rolling to produce a hot rolled strip.

3. The process in accordance with claim 1 wherein said rolling includes hot rolling said slab having a hot mill entry temperature in the range of 700° to 1100° F.

4. The process in accordance with claim 1 including employing a twin belt caster to produce a slab 0.2 to 2 inches thick.

5. The process in accordance with claim 2 including heating said slab prior to said hot rolling.

6. The process in accordance with claim 1 including hot rolling said slab to a thickness in the range of 0.01 to 0.25 inch.

7. The process in accordance with claim 1 including heating said slab to a temperature in the range of 800° to 1100° F. prior to said rolling.

8. The process in accordance with claim 2 including cold rolling said hot rolled strip to produce a cold rolled sheet.

9. The process in accordance with claim 8 including annealing said cold rolled sheet.

10. The process in accordance with claim 1 including casting a molten aluminum alloy selected from the group consisting of AA1XXX, AA3XXX, AA5XXX and AA6XXX alloys.

11. The process in accordance with claim 1 including casting a molten aluminum alloy selected from the group consisting of AA3004, AA5052, AA5182, and AA5754 alloys.

12. The process in accordance with claim 2 including cold rolling said hot rolled strip to a final gauge after said annealing step.

13. The process in accordance with claim 2 including cold rolling said hot rolled strip to a gauge in the range of 0.01 to 0.16 inch.

14. A process for producing an aluminum alloy sheet product having a controlled recrystallization using a twin belt caster to cast a molten aluminum alloy into a slab comprising:

(a) providing a source of molten aluminum alloy;

(b) providing a twin belt caster for continuously casting said molten aluminum alloy into a slab;

(c) hot rolling said slab into a hot rolled sheet product;

(d) continuously annealing said sheet product at an anneal temperature in a controlled temperature range to provide recrystallization of said hot rolled sheet product;

(e) monitoring said anneal temperature;

(f) measuring degree and type of recrystallization of said sheet product on a continuous basis to provide a recrystallization related signal;

(g) relaying said signal to a controller;

(h) in said controller, comparing said signal to previous signals relating to degree and type of recrystallization of said sheet product to provide a comparison; and (i) in response to said comparison, maintaining said anneal temperature or changing said anneal temperature upwardly or downwardly to produce aluminum alloy sheet product having desired recrystallization for high levels of formability.

15. The process in accordance with claim 14 including hot rolling said slab having a hot mill entry temperature in the range of 700° to 1100° F.

16. The process in accordance with claim 14 wherein said slab is 0.2 to 2 inches thick.

17. The process in accordance with claim 14 including heating said slab prior to said hot rolling.

18. The process in accordance with claim 14 including hot rolling said slab to a thickness in the range of 0.01 to 0.25 inch.

19. The process in accordance with claim 14 including heating said slab to a temperature of 800° to 1100° F. prior to hot rolling.

20. The process in accordance with claim 14 including cold rolling said hot rolled sheet product after annealing.

21. The process in accordance with claim 14 including cold rolling to final gauge said hot rolled sheet product after annealing.

22. The process in accordance with claim 14 including cold rolling said hot rolled sheet product to a gauge in the range of 0.01 to 0.16 inch.

23. The process in accordance with claim 14 wherein said aluminum alloy is an alloy selected from the group consisting of AA1XXX, AA3XXX, AA5XXX and AA6XXX aluminum alloys.

24. The process in accordance with claim 14 wherein said aluminum alloy is AA3004.

25. The process in accordance with claim 14 wherein said aluminum alloys are AA5052, AA5754 and AA5182.

26. A control method for continuously producing highly recrystallized, aluminum alloy sheet product having high levels of formability using a twin belt caster to cast a molten aluminum alloy into a slab comprising:

(a) providing a molten aluminum alloy selected from the group consisting of AA1XXX, AA3XXX, AA5XXX, and AA6XXX alloys;

(b) continuously casting the molten aluminum alloy into a slab;

(c) hot rolling said slab into a flat product at a hot rolling starting temperature in the range of 700° to 1100° F.;

(d) continuously annealing said flat product at an anneal temperature in a temperature range of 600° to 1100° F. to effect recrystallization of the flat product;

(e) monitoring at least one of said hot rolling starting temperature and annealing temperature;

(f) measuring degree of recrystallization of said flat product after annealing on a continuous basis to provide a recrystallization related signal;

(g) relaying said signal to a controller;

(h) in said controller comparing said signal to previous signals relating degree of recrystallization of said flat product to provide a comparison; and (i) in response to said comparison maintaining or changing at least one of said starting temperature and said anneal temperature upwardly or downwardly sufficient to produce aluminum alloy sheet having the recrystallization necessary to provide high levels of formability and desired earing.

27. The method in accordance with claim 26 including heating said slab prior to hot rolling.

28. The method in accordance with claim 26 including hot rolling said slab to a flat product having a thickness in the range of 0.01 to 0.25 inch.

29. The method in accordance with claim 26 including cold rolling said flat product after annealing.

30. The method in accordance with claim 26 including cold rolling said flat product after annealing to a gauge in the range of 0.01 to 0.16 inch.

31. The method in accordance with claim 26 wherein said alloy is AA3004.

32. The method in accordance with claim 26 wherein said alloy are AA5052, AA5754 and AA5182.

33. The method in accordance with claim 26 including maintaining or changing said starting temperature upwardly or downwardly to produce said sheet.

34. The method in accordance with claim 26 including maintaining or changing said anneal temperature upwardly or downwardly to produce said sheet.

35. A control method for producing recrystallized aluminum alloy sheet product using a continuous caster to cast a molten aluminum alloy comprising:

(a) providing a source of molten aluminum alloy;

(b) continuously casting said molten aluminum alloy into a slab;

(c) hot rolling said slab into a flat rolled product in a temperature range;

(d) continuously annealing said flat rolled product at a temperature in the range of 600° to 1100° F. to provide a recrystallized, annealed, flat rolled product;

(e) measuring recrystallization of said annealed flat rolled product to provide a recrystallization related signal;

(f) relaying said signal to a controller;

(g) in said controller comparing said signal to signals relating degree of recrystallization of said annealed, flat rolled product to provide a comparison; and (h) in response to said comparison maintaining temperature of one of said slab or increasing or decreasing temperature of said slab to produce a flat rolled product having a recrystallized structure.

36. The method in accordance with claim 35 including hot rolling said slab starting at a temperature in the range of 700° to 1100° F.

37. The process in accordance with claim 35 including employing a twin belt caster to produce a slab 0.2 to 2 inches thick.

38. The process in accordance with claim 35 including heating said slab prior to said hot rolling.

39. The process in accordance with claim 35 including hot rolling said slab to a thickness in the range of 0.01 to 0.25 inch.

40. The process in accordance with claim 35 including heating said slab to a temperature in the range of 800° to 1100° F. prior to said rolling.

41. The method in accordance with claim 35 including cold rolling said annealed, flat rolled product to produce a cold rolled sheet product.

42. The method in accordance with claim 35 including cold rolling said annealed, flat rolled product to a thickness of 0.01 to 0.16 inch.

43. The process in accordance with claim 35 including casting a molten aluminum alloy selected from the group consisting of AA1XXX, AA3XXX, AA5XXX and AA6XXX alloys.

44. The method in accordance with claim 35 wherein said aluminum alloy is AA3004.

45. The method in accordance with claim 35 wherein said aluminum alloy are AA5052, AA5754 and AA5182.

46. A process for producing an aluminum alloy sheet product having a controlled recrystallization using a twin belt caster to cast a molten aluminum alloy into a slab comprising:

(a) providing a source of molten aluminum alloy;

(b) providing a twin belt caster for continuously casting said molten aluminum alloy into a slab;

(c) hot rolling said slab into a hot rolled sheet product at a temperature in a hot rolling temperature range;

(d) monitoring hot rolling temperature;

(e) measuring degree and type of recrystallization of said sheet product on a continuous basis to provide a recrystallization related signal;

(f) relaying said signal to a controller;

(g) in said controller, comparing said signal to previous signals relating to degree and type of recrystallization of said sheet product to provide a comparison; and (h) in response to said comparison, maintaining said hot rolling temperature or changing said hot rolling temperature upwardly or downwardly to produce aluminum alloy sheet product having desired recrystallization for high levels of formability.

47. The method in accordance with claim 46 including measuring grain structure and texture of finished sheet.

48. A control method for continuously producing highly recrystallized, aluminum alloy sheet product having high levels of formability using a twin belt caster to cast a molten aluminum alloy into a slab comprising:

(a) providing a molten aluminum alloy selected from the group consisting of AA1XXX, AA3XXX, AA5XXX and AA6XXX alloys;

(b) continuously casting the molten aluminum alloy into a slab;

(c) hot rolling said slab into a flat product at a hot rolling starting temperature in the range of 700° to 1100°;

(d) monitoring said hot rolling starting temperature;

(c) measuring degree and type of recrystallization of said flat product after hot rolling on a continuous basis to provide a recrystallization related signal;

(f) relaying said signal to a controller;

(g) in said controller comparing said signal to previous signals relating degree and type of recrystallization of said flat product to provide a comparison; and (h) in response to said comparison, maintaining or changing said starting temperature upwardly or downwardly sufficient to produce aluminum alloy sheet having the recrystallization necessary to provide high levels of formability and desired earing.

49. A control method for producing recrystallized aluminum alloy flat rolled product using a continuous caster to cast a molten aluminum alloy comprising:

(a) providing a source of molten aluminum alloy;

(b) continuously casting said molten aluminum alloy into a slab;

(c) hot rolling said slab into a flat rolled product in a temperature range to produce a flat rolled product;

(d) measuring recrystallization of said flat rolled product to provide a recrystallization related signal;

(e) relaying said signal to a controller;

(f) in said controller comparing said signal to signals relating degree and type of recrystallization of said flat rolled product to provide a comparison; and (g) in response to said comparison maintaining temperature of said slab or increasing or decreasing temperature of said slab to produce a fiat rolled product having a recrystallized structure.

50. The method in accordance with claim 49 including measuring grain structure and texture of finished sheet.

51. The method in accordance with claim 49 including hot rolling said slab starting at a temperature in the range of 700° to 1100° F.

52. The process in accordance with claim 49 including employing a twin belt caster to produce a slab 0.2 to 2 inches thick.

53. The process in accordance with claim 49 including heating said slab prior to said hot rolling.

54. The process in accordance with claim 49 including hot rolling said slab to a thickness in the range of 0.01 to 0.25 inch.

55. The process in accordance with claim 49 including heating said slab to a temperature in the range of 800° to 1100° F. prior to said rolling.

56. The method in accordance with claim 49 including cold rolling said flat rolled product to produce a cold rolled sheet product.

57. The method in accordance with claim 49 including cold rolling said flat rolled product to a thickness of 0.01 to 0.160 inch.

58. The process in accordance with claim 48 including casting a molten aluminum alloy selected from the group consisting of AA1XXX, AA3XXX, AA5XXX and AA6XXX alloys.

59. A process for producing an aluminum alloy sheet product having a controlled grain structure and texture using a continuous caster to cast a molten aluminum alloy into a slab comprising:

(a) providing a source of molten aluminum alloy;

(b) providing a caster for continuously casting said molten aluminum alloy into a slab;

(c) rolling said slab into a sheet product;

(d) continuously annealing said sheet product at a temperature in a controlled temperature range;

(e) measuring grain structure and texture of said sheet product on a continuous basis to provide a grain structure and texture related signal;

(f) relaying said signal to a controller;

(g) in said controller, comparing said signal to previous signals relating grain structure and texture of said sheet product to provide a comparison; and (h) in response to said comparison, maintaining or changing said temperature in said temperature range upwardly or downwardly to produce aluminum sheet product having desired grain structure and texture.

60. A process for producing an aluminum alloy sheet product having a controlled grain structure and texture using a twin belt caster to cast a molten aluminum alloy into a slab comprising:

(a) providing a source of molten aluminum alloy;

(b) providing a twin belt caster for continuously casting said molten aluminum alloy into a slab;

(c) hot rolling said slab into a hot rolled sheet product;

(d) continuously annealing said sheet product at an anneal temperature in a controlled temperature range to provide grain structure and texture of said hot rolled sheet product;

(e) monitoring said anneal temperature;

(f) measuring grain structure and texture of said sheet product on a continuous basis to provide a grain structure and texture related signal;

(g) relaying said signal to a controller;

(h) in said controller, comparing said signal to previous signals relating to grain structure and texture of said sheet product to provide a comparison; and (i) in response to said comparison, maintaining said anneal temperature or changing said anneal temperature upwardly or downwardly to produce aluminum alloy sheet product having desired grain structure and texture for high levels of formability.

61. A control method for continuously producing highly recrystallized, aluminum alloy sheet product having high levels of formability using a twin belt caster to cast a molten aluminum alloy into a slab comprising:

(a) providing a molten aluminum alloy selected from the group consisting of AA1XXX, AA3XXX, AA5XXX and AA6XXX alloys;

(b) continuously casting the molten aluminum alloy into a slab;

(c) hot rolling said slab into a flat product at a hot rolling starting temperature in the range of 700° to 1100° F.;

(d) continuously annealing said flat product at an anneal temperature in a temperature range of 600° to 1100° F. to effect grain structure and texture of the flat product;

(e) monitoring at least one of said hot rolling starting temperature and annealing temperature;

(f) measuring grain structure and texture of said flat product after annealing on a continuous basis to provide a grain structure and texture related signal;

(g) relaying said signal to a controller;

(h) in said controller comparing said signal to previous signals relating grain structure and texture of said flat product to provide a comparison; and (i) in response to said comparison maintaining or changing at least one of said starting temperature and said anneal temperature upwardly or downwardly sufficient to produce aluminum alloy sheet having the grain structure and texture necessary to provide high levels of formability and desired earing.

62. A control method for producing recrystallized aluminum alloy sheet product using a continuous caster to cast a molten aluminum alloy comprising:

(a) providing a source of molten aluminum alloy;

(b) continuously casting said molten aluminum alloy into a slab;

(c) hot rolling said slab into a flat rolled product in a temperature range;

(d) continuously annealing said flat rolled product at a temperature in the range of 600° to 1100° F. to provide a recrystallized, annealed, flat rolled product;

(e) measuring grain structure and texture of said annealed flat rolled product to provide a grain structure and texture related signal;

(f) relaying said signal to a controller;

(g) in said controller comparing said signal to signals relating grain structure and texture of said annealed, flat rolled product to provide a comparison; and (h) in response to said comparison maintaining temperature of one of said slab or increasing or decreasing temperature of said slab to produce a flat rolled product having a desired recrystallized structure.

63. The method in accordance with claim 62 including measuring grain structure and texture of finished sheet.

* * * * *